US006334805B1

(12) United States Patent
Sawamoto

(10) Patent No.: US 6,334,805 B1
(45) Date of Patent: Jan. 1, 2002

(54) FEMALE CLOTHING WITH CUP UNIT

(75) Inventor: Koshi Sawamoto, Hyogo-ken (JP)

(73) Assignee: Riverstone Co., Ltd., Kobe (JP)

( * ) Notice: Subject to any disclaimer, the term of this patent is extended or adjusted under 35 U.S.C. 154(b) by 0 days.

(21) Appl. No.: 09/601,626

(22) PCT Filed: Sep. 8, 1999

(86) PCT No.: PCT/JP99/04910

§ 371 Date: Aug. 4, 2000

§ 102(e) Date: Aug. 4, 2000

(87) PCT Pub. No.: WO00/15062

PCT Pub. Date: Mar. 23, 2000

(30) Foreign Application Priority Data

Sep. 14, 1998 (JP) ..... 10-260472

(51) Int. Cl.[7] ..... A41C 3/00
(52) U.S. Cl. ..... 450/40
(58) Field of Search ..... 450/40–42, 44, 450/47–49, 51–53

(56) References Cited

U.S. PATENT DOCUMENTS 2,595,088 A * 4/1952 Licht ..... 450/47
3,114,374 A * 12/1963 Chalfin et al. ..... 450/41
3,562,802 A * 2/1971 Avis ..... 450/41

* cited by examiner

*Primary Examiner*—Gloria M. Hale
(74) *Attorney, Agent, or Firm*—Armstrong, Westerman, Hattori, McLeland & Naughton, LLP

(57) ABSTRACT

Female clothing such as a brassiere which is represented by a foundation having a cup unit having a breast support feature and a shape retaining feature and which comprises a breast retaining member (10) provided along a lower peripheral edge (1) and a side peripheral edge (2) and provided with a curved breast shape correcting and hardening region formed by molding a knitting fabric of thermoplastic synthetic resin fibers, the retaining member (10) being formed with a sectionally semicircular, curved strip (13) projecting outwardly and extending in the curved breast shape correcting and hardening region of the retaining member (10) and in parallel with the lower peripheral edge (1) and the side peripheral edge (2) of the cup unit, or being formed, instead of the curved strip (13), with a tensioned slender plain weave rubber string (14) sewn to the inner surface of the region, the curved strip (13) having an elastic resin bar (16) inserted into a recessed groove thereof, thereby providing female clothing which does not expand laterally under the bulkiness and weight of a bust to ensure breast supporting and shape retaining features and which can deliver an extended bust correction function.

12 Claims, 4 Drawing Sheets

FEMALE CLOTHING WITH CUP UNIT

TECHNICAL FIELD

The present invention relates to female undergarments or swimsuits represented by a garment having a breast-retaining cup unit such as camisoles, two-piece brassiere garments, bustiers, one-piece brassiere garments, and the like. More specifically, it relates to a brassiere.

BACKGROUND OF THE INVENTION

Some female garments having a cup unit, represented by a brassiere, provide a bust shape correction function by means of a wire provided along the lower peripheral edge of the cup unit (hereafter referred to as the wire-type). Usually, the wire is fine and hard being made of metal or hard plastic material. As a result, when a wearer puts on the garment with the wire, the wire bits into her body making her feel uncomfortable. A non-wire-type garment can overcome this problem. However, it does not provide the bust shape correction function.

For this reason, a comfortable garment with a breast shape correcting function is demanded in the market. A non-wire type brassiere comprising a supporting member made of the same material as the cup unit has been proposed. This type provided the bust shape correction function, nevertheless, it was deficient in that the correction function did not last for a long time. Particularly, the breast-shape correction function was lost when the clothing was washed repeatedly.

Among those females garments, such as a brassiere having a cup unit, some garments are provided with a cup unit with a breast retaining member, which is formed by molding a knitting fabric of thermoplastic synthetic resin fibers (e.g. polyester fibers) along the lower peripheral edge and the side peripheral edge of the cup unit. The breast retaining member built into this female garment is made of a polyester strip, and has gained a decent reception for its comfortable-to-wear and breast shape correcting features.

Usually, the female garment having a cup unit with the polyester strip-type retaining member works excellently for females with small breasts. It causes problems, however, when it is applied to the garments for females with large busts such as the D- or E-cup sizes; a molded polyester strip breast retaining member built into the garment, like a brassiere, loses its bust shape correction function under the weight of a bust and expands laterally. Much more improvement is required for the female garment to overcome this problem.

The object of the present invention is to provide a female garment having a cup unit, more specifically, a brassiere of the D- and E-cup sizes that can ensure the bust correction function for a long time by means of a built-in polyester strip retaining member built therein. The present invention intends to overcome the problem that the breast retaining member does not expand laterally over time under the weight of a bust due to the loss of breast supporting and shape retaining effects.

DETAILED DESCRIPTION OF THE INVENTION

The first aspect of the present invention provides a female garment having a cup unit comprising a breast retaining member providing a curved, hardened region for correcting breast shape, which is formed by molding a knitting fabric of thermoplastic synthetic resin fibers arranged along the lower peripheral edge and the side peripheral edge of the cup unit, wherein the curved, hardened region for correcting breast shape of the breast retaining member is formed with a sectionally semicircular curved strip that projects outward and extends in parallel with the lower peripheral edge (1) and the side peripheral edge (2) of the cup unit.

In other words, a sectionally semicircular curved strip is provided in such a way that it extends along the lower peripheral edge and the side peripheral edge of the cup unit that comprises the hardened region for correcting breast shape of the breast retaining member. Different sections are provided in the same mold for the sectionally semicircular curved strip and the hardened region for correcting breast shape so that the curved strip and the region are molded simultaneously: The strip has the same hardness as the hardened bust shape correction and hardening region. Specifically, the area without the curved strip is shaped flat; the curved strip portion in the hardened region for correcting breast shape is of a wavy shape. The waviness provides a larger rigidity against bending force. This breast retaining member can therefore provide the breast supporting and shape retaining function for females with particularly large breasts. It can further be used for garments designed for females of larger busts who wear the D- and E-cup sizes.

In addition, the curved strip projects outwardly, the sectional semicircular portion projects opposite to the wearer's body. The garment having this breast retaining member, therefore, does not tighten up the wearer's body, and it is comfortable to wear.

The second aspect of the present invention provides a female garment having a cup unit comprising a breast retaining member providing a curved, hardened region for correcting breast shape, which is formed by molding a knitting fabric of thermoplastic synthetic resin fibers arranged along the lower peripheral edge and the side peripheral edge of the cup unit. The curved, hardened region for correcting breast shape of the breast retaining member is provided with a sectionally semicircular curved strip that projects outwardly and extends parallel to the lower peripheral edge and the side peripheral edge of the cup unit, and an elastic resin bar is applied to a recessed groove on the back of the curved strip. In other words, an elastic resin (plastic) bar is applied to the recessed groove formed on the back side of the curved strip, the means provided in claim 1, on the side at which it contacts a wearer's body. The curved strip reinforces the rigidity of the breast retaining member. Being inserted in a recessed groove of the curved strip, the elastic resin bar further reinforces the rigidity of the breast retaining member. The elastic resin bar is obtained by placing a flat strip-type metallic mold on the back of the recessed groove of the curved strip, and by injecting a plastic therein, followed by curing. The elastic bar can also be obtained by adhesively attaching an elastic resin bar that is large enough to fit the recessed groove of the curved strip. It can also be made by welding an elastic resin bar to the curved strip which is a polyester plate type retaining member. Preferably, the elastic resin bar is large enough to fit the recessed groove of the curved strip. Desirably, the elastic resin bar should not project inwardly on the back side of the sectionally semicircular, curved strip so it would not project on the wearer's skin.

The third aspect of the present invention provides a female garment having a cup unit comprising a breast retaining member providing a curved, hardened region for correcting breast shape, which is formed by molding a knitting fabric of thermoplastic synthetic resin fibers arranged along the lower peripheral edge and the side peripheral edge of the cup unit. A tensional slender flat woven rubber string is sewn to the inner surface of the curved, hardened region for correcting breast shape of the breast retaining member while stretched, specifically, throughout the region along the longer border (hereafter referred to "hem") that extends in parallel with the lower peripheral edge and the side peripheral edge of the cup unit. The effect of sewing the rubber string is that the curved, hardened region for correcting breast shape bends inwardly. In other words, a slender flat woven rubber string is sewn to the inner surface of the curved, hardened region for correcting breast shape of the breast retaining member while stretched. Specifically, it is sewn throughout the region along the hem that extends parallel to the lower peripheral edge and the side peripheral edge of the cup unit, so that the curved, hardened region for correcting breast shape bends inwardly: the tension is applied such that the curvature is smaller for the breast shape correcting and retaining region bending inwardly. This reinforces the initial inward tensional force that the hardened region for correcting breast shape provides where it contacts the wearer's breast. Therefore, it will not expand laterally under the bulkiness and weight of a bust and ensure breast shape correcting function.

The forth aspect of the present invention provides a female garment having a cup unit wherein the outward projecting sectional semicircular, curved strip, which is a molded breast retaining member shaped in a sectionally curved member in the hardened region for correcting breast shape, is provided along the lower peripheral edge and the side peripheral edge of the cup unit, which is the upper surface of the molded sectionally curved member. In other words, the rigidity against bending of the cup unit is reinforced by providing the breast retaining member along the lower peripheral edge an the side peripheral edge of the cup unit, which is the upper surface of the molded sectionally curved member, which is a molded breast retaining member in the hardened region for correcting breast shape.

The fifth aspect of the present invention provides a female garment having a cup unit wherein the outward projecting sectionally semicircular curved strip which is a molded breast retaining member shaped in a sectionally curved member in the hardened region for correcting breast shape is provided at the outer edge of the cup unit, which is the lower surface of the curved member in the hardened region for correcting breast shape.

The sixth aspect of the present invention provides a female garment having a cup unit which a slender, flat woven rubber string is sewn while stretched, to the inner surface of the curved, hardened region for correcting breast shape of the breast retaining member. Specifically, the slender, flat woven string sewn while stretched throughout the region along the hem is a slender, flat woven rubber string of a length 15–20% less than the length of the hem region of the inner surface of the hardened region for correcting breast shape of the breast retaining member. The slender flat woven rubber sewn in this case is, of course, not one with a strong tension but is the type that is commercially available and commonly used for undergarments because it is comfortable. The slender flat woven rubber string is 15–20% shorter than the entire length of the hardened region for correcting breast shape along the hem. Therefore, the tension required for bending the hardened region for correcting breast shape inwardly can be applied while providing comfort and the shape correcting function for a long time.

The seventh aspect of the present invention provides a female garment having a cup unit wherein the female garment having a cup unit is a brassiere. In other words, it is a brassiere which can take advantage of the present invention.

The material used for the breast retaining member of the present invention is a polyester fabric of a thermoplastic resin. This material is advantageous in that the breast shape correcting region of the breast retaining member in the center of the cup unit can be made softer toward the edge by increasing the temperature to 190° C. at the high end during molding. This provides a desirable shape with appropriate hardness, shape-retainability, stretchability, and elasticity with excellent comfort.

Moreover, the breast retaining member is made of a knitted fabric, specifically the fabric knitted circularly [in tube] or by the double Russell technique. The fabric has elastic properties and it is easy to attach to the curved mold. Particularly, the fabrics knitted circularly [in tube] or by the double Russell technique easily provide the thickness required for the breast retaining member.

Furthermore, the breast retaining member of the present invention is sandwiched with cup construction materials of different hardness putting the breast retaining member therebetween. Therefore, a soft material can be placed to the side which contacts the wearer's body so as to make the garment more comfortable.

The cup unit in a female garment of the present invention does not use metallic wire at all. This makes it possible for the product to go through the needle sensor used to detect sewing needles accidentally left in the product. This, in effect, makes it easier to ensure the product safety.

BRIEF DESCRIPTION OF THE DRAWINGS

FIG. 6 shows the breast retaining member in which a tensional slender flat woven rubber string is sewn throughout the region along the hem of the inner surface of the curved, hardened region for correcting breast shape of the breast retaining member such that the curved, hardened region for correcting breast shape bends inwardly.

Symbols are described as follows: 1 is a lower peripheral edge; 2 is a side peripheral edge, 3 is a lower cup; 4 is a center cup; 5 is an upper cup; 6 is an upper peripheral edge; 7 is an outer peripheral edge; 10 is a breast retaining member; 11 is an upper surface; 12 is a lower surface; 13 is a curved strip; 14 is a slender flat rubber strip; 15 is a seam;

16 is an elastic resin bar; 20 is a cup constructing material; 21 is an external material; 22 is an inner material.

BEST MODE FOR REDUCTION TO PRACTICE

Figure 1:
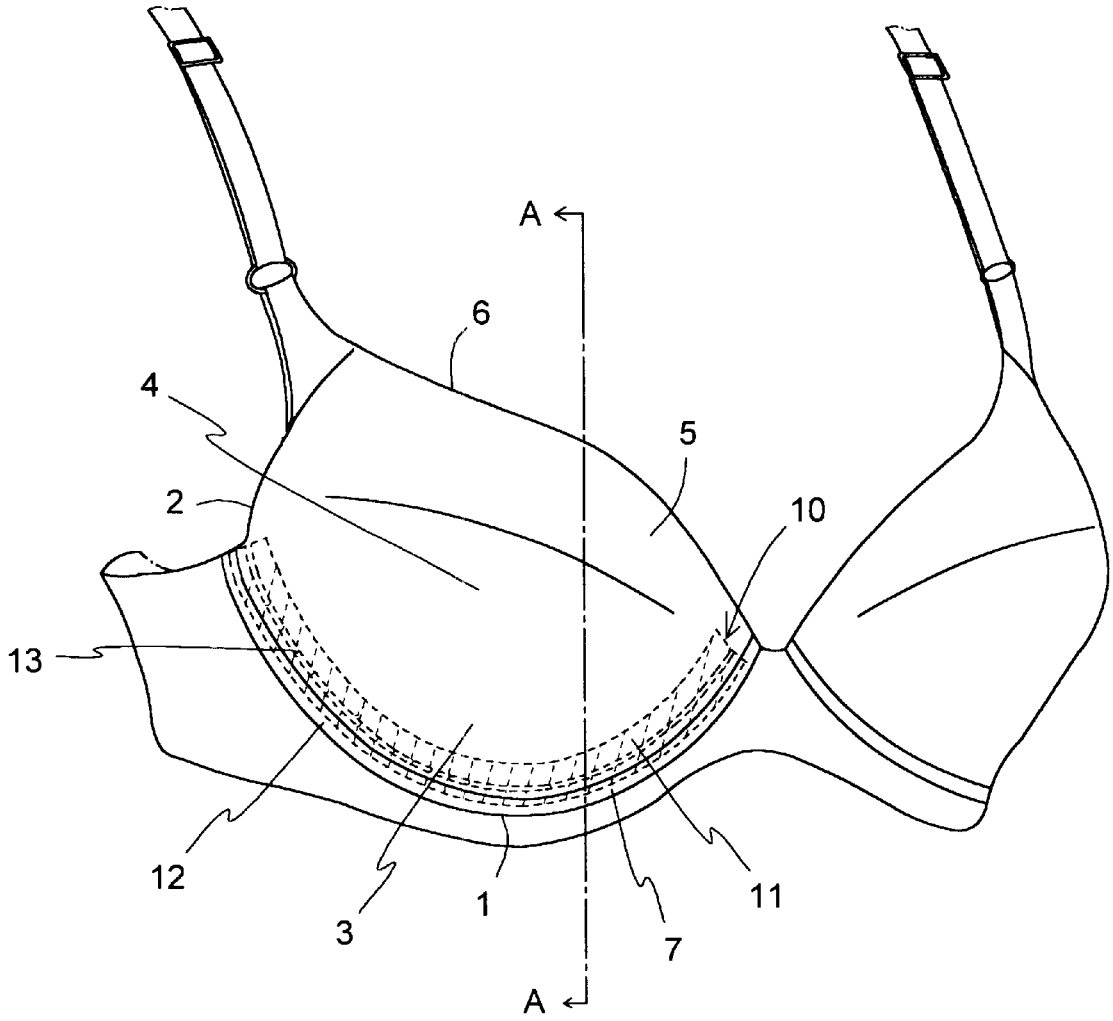
FIG. 1 is a frontal head-on view of one of the embodiments of the female garment having a cup under of the present invention.
Figure 2:
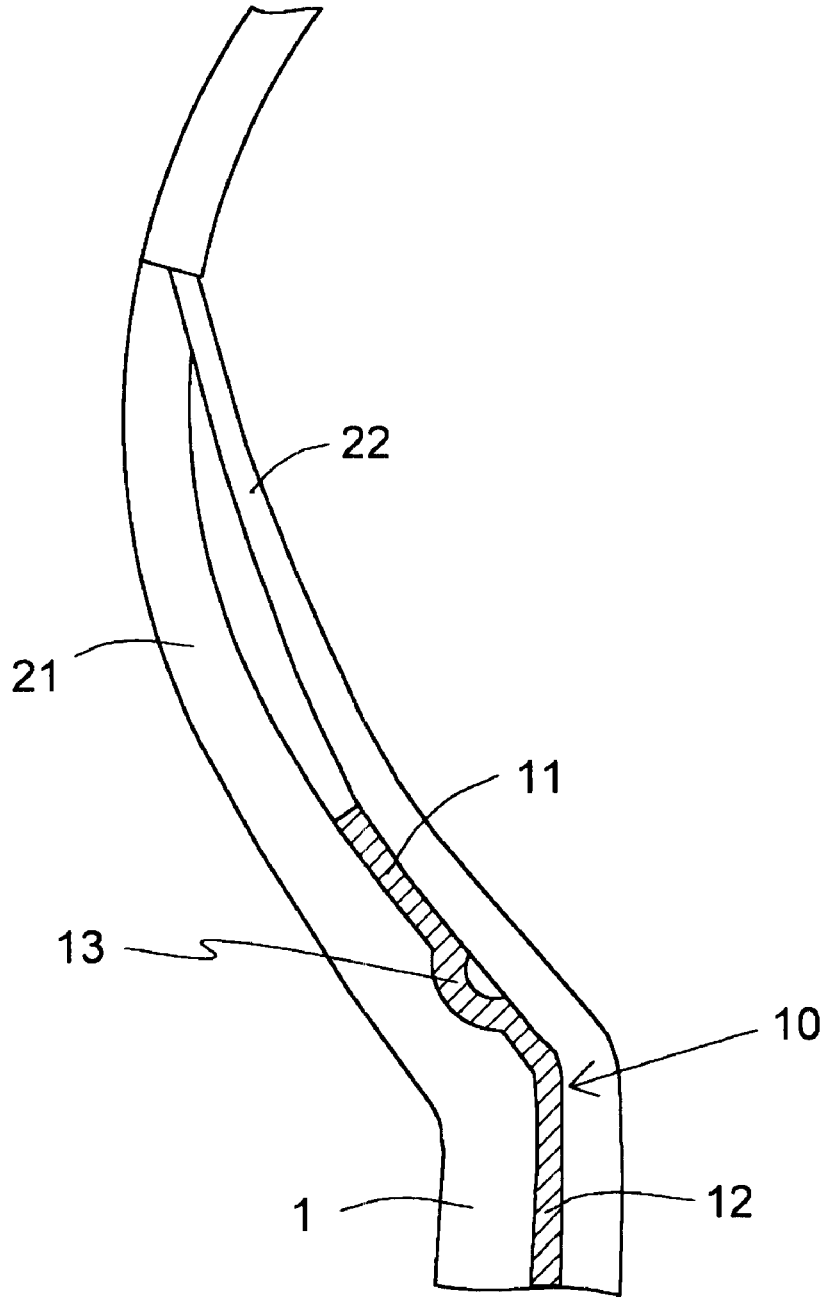
FIG. 2 is a cross-sectional view of FIG. 1 along line A—A.
Figure 3:
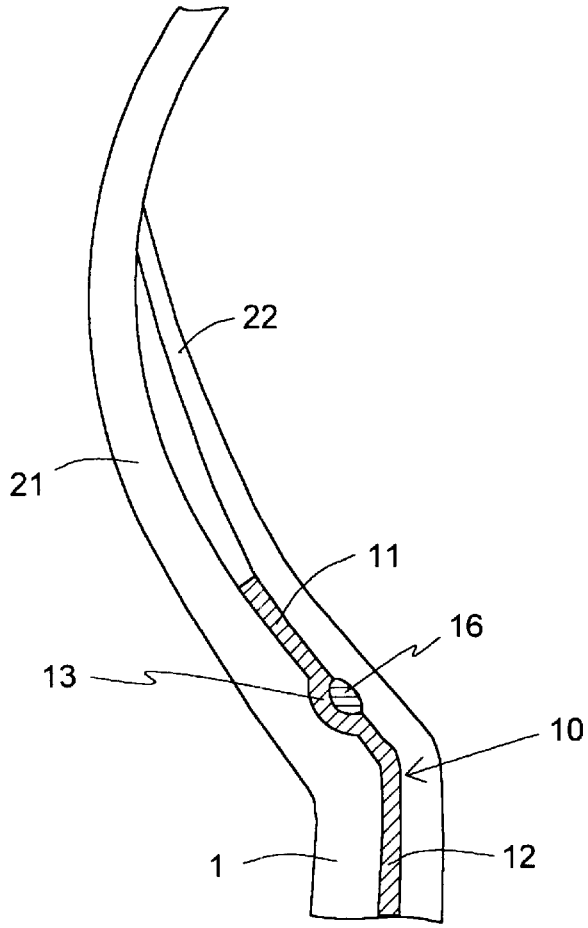
FIG. 3 is the same cross-sectional view as FIG. 2 showing the brassiere having an elastic resin bar in the recessed groove of a curved strip.
Figure 4:
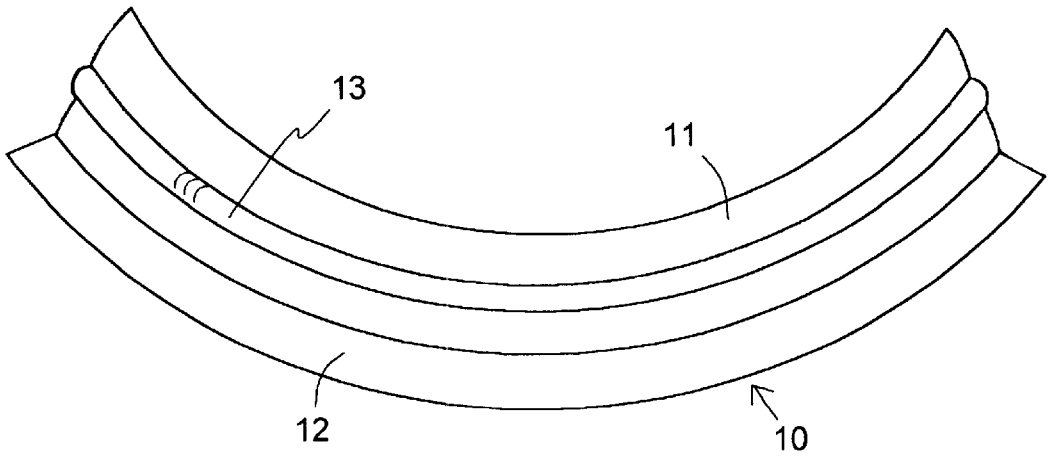
FIG. 4 is a frontal head-on view of the breast retaining member provided with a sectionally semicircular curved strip that is molded to provide the sectionally curved strip on the upper surface in the molded hardened region for correcting breast shape such that the curved strip projects outwardly and extends parallel to the lower peripheral edge of the region.
Figure 5:
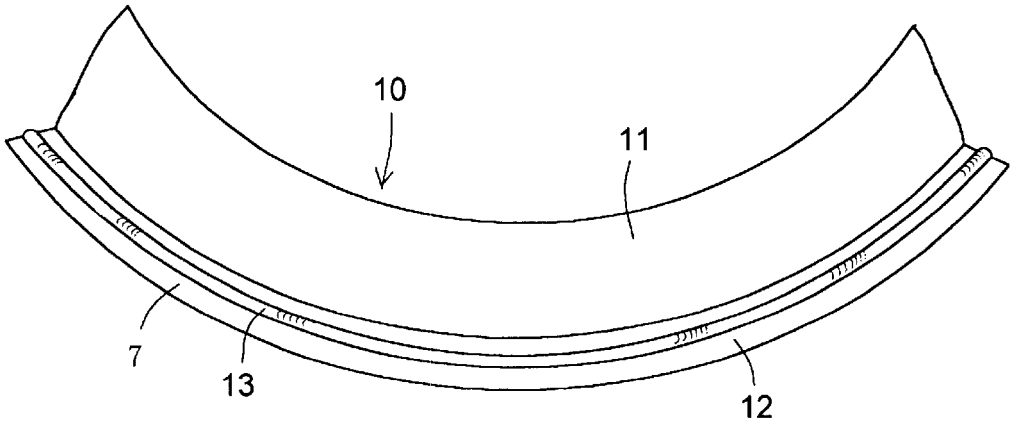
FIG. 5 is a frontal-head-on view of the breast retaining member provided with a sectionally semicircular curved strip, a molded hardened region for correcting breast shape provided along the outer edge of the cup unit, which is along the lower surface of the curved strip, in an arrangement in which the strip projects outwardly and extends along the lower surface of the cup unit.
Figure 6:
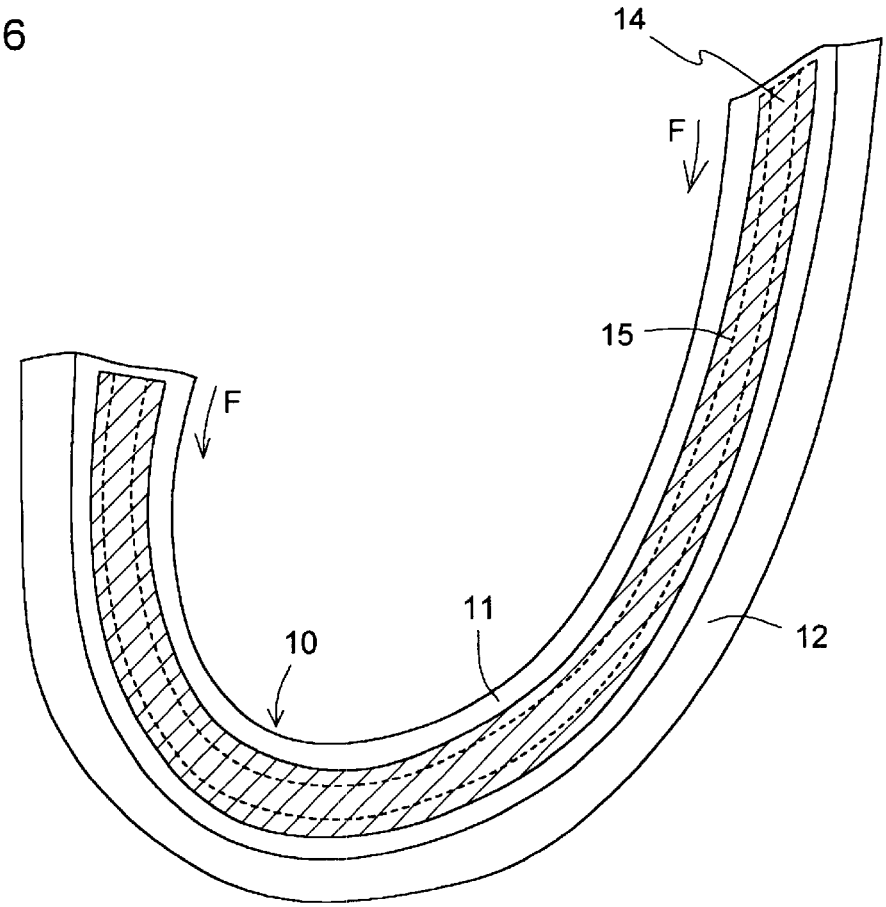
FIG. 6 is a rear view of the breast retaining member the surface of which the wearer's body contacts.

Embodiments of the present invention are described herein with reference to the drawings. FIG. 1 is a frontal-head-on view of a brassiere of one of the embodiments of the female garment of the present invention. FIG. 2 is a cross-sectional view of FIG. 1 along line A—A. FIG. 3 is the same cross-sectional view as FIG. 2 showing the brassiere having an elastic resin bar in the recessed groove of a curved strip. FIG. 4 is a frontal-head-on view of a breast retaining member provided with a sectionally semicircular curved strip that is molded to provide the sectionally curved strip in the molded, hardened region for correcting breast shape with the curved strip extending parallel to the outer edge of the cup unit FIG. 5 is a frontal-head-on view of the breast retaining member, which is molded in the shape of a sectionally semicircular curved strip, provided in the hardened region for correcting breast shape projecting outwardly and extending parallel to the outer edge of the cup unit. The semicircular curved strip is on the lower surface of the curved strip in the hardened region for correcting breast shape. FIG. 6 is a rear view of the breast retaining member the surface of which the wearer's body contacts. FIG. 6 shows the breast retaining member in which a slender flat woven rubber string is sewn while stretched throughout the curved, hardened region for correcting breast shape of the breast retaining member along the hem on the inner surface of the cup unit such that the curved, hardened region for correcting breast shape bends inwardly.

In FIG. 1, the cup unit comprises a lower peripheral edge (1), a side peripheral edge (2), a lower cup (3), a center cup 4, an upper cup (5), and an upper peripheral edge (6). Throughout the lower peripheral edge (1), a breast retaining member (10) of a nearly uniform width is formed. The breast retaining member (10) is made by molding a knitted fabric knitted by the circular or double Russell knitting technique in a heated metallic mold. To ensure that a bust is pushed up and supported in a constant shape by the force of a lower cup (3) as shown in FIG. 2, a sectionally curved, hardened region for correcting breast shape is provided. Additionally, a curved strip (13) is provided at the lower peripheral edge (1) of a cup unit, which is located in the upper surface (11) of the curved member in the sectionally curved, hardened region for correcting breast shape, and its projects outwardly. In this way, a wavy strip is created. The curved strip (13) is molded simultaneously with the breast retaining member (10) because different sections are provided for both components in the same mold. The curved strip (13) extends parallel to the lower peripheral edge (1) of the cup unit as shown in FIGS. 1 and 4.

The breast retaining member (10) is arranged as follows:

- the lower surface (12) of the sectionally curved member, which is the lower part of the breast retaining member (10), overlaps with the sectionally curved lower part of the lower cup (3),
- the upper surface (11) of the sectionally curved member overlaps with the lower part of the lower cup (3);
- the upper surface (11) and the lower surface (12) of the curved portion of the curved member are joined and sandwiched in between:
  - an external material (21) which is harder than other cup constructing materials (2) of different hardnesses; and
  - an internal material (22), which is soft and is placed on the side with which the wearer's body comes into contact, putting the sectionally curved member therebetween.

To push up a bust for correcting its shape, the breast retaining member (10) is arranged in such a way that it extends upward above the position at which a curved portion of the upper surface (11) and the lower surface (12) are joined, with the curved portion therebetween, creating the upper surface (11). As shown in FIG. 2, the curved strip (13) formed along the upper surface (11) of the breast retaining member (10) projects upward: a soft inner material (22) is sewn on the surface that contacts the wearer's body, making the sewn surface free from any projections. The wearer's body, therefore, will not be pressed by any foreign matter.

The female garment, specifically a brassiere, is constructed with the cup construction materials similar to the breast retaining member (10), with the internally formed semicircular curved strip (13) therebetween. This is advantageous because this breast retaining member (10) is given a reinforced rigidity by the wavy curved strip (13) and does not bend easily.

As a result, when it is applied to the cup for larger breast sizes, the bust shape correction function will not be affected and will not laterally expand under the bulkiness and weight of a large bust.

FIG. 3 is a cross-sectional view of the brassiere having an elastic resin bar (16) in the recessed groove of a curved strip. The elastic synthetic resin bar (16) is applied by the following injection molding technique:

- previously molding the curved strip (13) of the breast retaining member (10) of the embodiment as shown in FIGS. 1 and 2;
- inserting an elastic synthetic resin (e.g. elastomers) into the curved strip (13):
  - the bar is formed by:
  - placing a flat strip-type metallic mold at the back of the recessed groove of the curved strip;
  - injecting (inserting) an elastomer or the like therein; and
  - curing.

The elastic bar can also be obtained by adhesively attaching an elastic resin bar that is large enough to fit the recessed groove of the curved strip. It can also be made by welding an elastic resin bar to the curved strip which is a polyester plate type retaining member. Preferably, the breast retaining member (10) is sewed in such a way that the elastic resin bar (16) does not project from the surface at the side of the breast retaining member (10), with which the bar comes in contact with the wearer's body. One of the advantages of this would be to provide a brassiere that does not make the wearer feel that some foreign matter is projecting into the wearer's skin.

FIG. 4 is a plan view of an embodiment of the cured sectionally semicircular curved strip (13) projecting outward as shown in FIG. 2. It is arranged along the upper surface (11) of the curved strip provided along the lower peripheral edge of the cup unit of the breast retaining member (10).

FIG. 5 is a frontal-head-on view of an embodiment of the curved sectionally semicircular curved strip (13) projecting outward. It is provided along the lower surface (12) of the curved strip along the lower peripheral edge (1) of the cup unit of the breast retaining member (10). The weight of a bust works particularly on the lower face (12) of the curved member along the lower peripheral edge (1) of the cup unit. The strip can bend easily. Essentially, to prevent losing the breast shape correcting and the supporting function, it should be difficult to bend the strip used for the breast retaining member (10) when it represents the embodiment of the present invention as shown in FIG. 4.

FIGS. 4 and 5 represent the use of a single curved strip (13). However, multiple curved strips (13) can be applied.

The curved strip (13) may also be applied to the upper surface (11) and the lower surface (12) together. In this way, the breast shape correcting and supporting function can last for a long time.

FIG. 6 shows the breast retaining member (10) of a different concept compared to the ones described above. Nonetheless, it provides the breast shape correcting and supporting function for a long time. FIG. 6 is a diagram showing the breast retaining member (10) viewed from the rear side at which it contacts the wearer's body. A slender flat woven rubber strip (14) that fits with width of the upper surface (11) is sewn while stretched onto the surface at the side it contacts the wearer's body in the upper surface (11) of the curved member of the breast retaining member (10) as indicated with seams (15). The breast retaining member (10) is molded to fit a curved breast (recess toward the wearer's body) providing a hardened correcting region along the bust. When sewing the slender flat woven rubber strip (14) on the internal surface of the curved, hardened region for correcting breast shape with some tension, the force indicated with an arrow marked "F" in FIG. 6 constantly works on the breast retaining member (10). When the breast retaining member (10) is used for the cup units of larger sizes, this configuration makes it possible to maintain the breast shape correcting and supporting function for a long time. In addition, this configuration overcomes the problem that the original shape of the hardened region for correcting breast shape is extended laterally under the weight of the bust.

The slender flat woven rubber string (14) is commercially available. It is commonly used for undergarments and ha a normal tension. If the curved, hardened region for correcting breast shape of the curved breast retaining member (10) is 210 mm long, the slender flat woven rubber strip (14) is about 180 mm long, which is 85% of the region. Additionally, if the hardened region for correcting breast shape of the breast retaining member (10) is 20 mm wide, the rubber string should be 15 mm wide, which is slightly narrower than the region.

The breast retaining member (10) of the present invention has been described so far. When it is used in garments having a cup unit for females, it can be applied to brassieres or other garments by providing it with cup unit construction materials therebetween, as described above with reference to FIG. 2.

The type in which the breast retaining member (10) is provided along the lower peripheral edge (1) of the cup unit was described above as the embodiment of the present invention. The present invention can also be applied to the female garments with the breast retaining member (10) provided along the side peripheral edge (2) of FIG. 1. Applications of the present invention are not limited to the embodiments described above. A curved strip (13) can be formed on the breast retaining member (10) and a tensioned slender flat woven rubber string (14) may be sewed thereon to ensure the effect of supporting a larger bust.

POSSIBLE ADVANTAGEOUS INDUSTRIAL APPLICATIONS

As described above, the female garment having a breast-shaped cup unit of the present invention overcomes the drawbacks and keeps the merits of both the wire-type and non-wire type. The presence of the curved, hardened region for correcting breast shape of a thermoplastic synthetic resin fabric that is provided along the lower peripheral edge and the side peripheral edge of the cup unit of the female garment having a cup unit, the female garment having a breast retaining member provides the following advantages:

the hardness that ensures supporting a bust;

stretchability that makes sewing possible;

the breast shape reproducibility.

Additionally, the breast retaining member having the curved, hardened region for correcting breast shape is provided with a curved strip projecting outward along the hardened region for correcting breast shape. Therefore, its rigidity against bending is improved. As a result, the curved breast shape correcting and supporting function of the breast retaining member will support the weight of a large bust, without extending laterally, if it is applied to the construction of cups for larger bust sizes. Moreover, the curved strip is arranged opposite the side that contacts the wearer's body. Therefore the strip will not be felt as a foreign matter that projects into the wearer. The wearer will be comfortable when wearing the garment. Furthermore, the curved strip can be molded with the hardened region for correcting breast shape at the same time, which reduces the cost of manufacturing.

The breast retaining member having the curved, hardened region for correcting breast shape is sewn while stretched with a slender flat woven rubber strip along the inner surface of the curved, hardened region for correcting breast shape that contacts the wearer's body. In this way, the force acting on the curved hardened region for correcting breast shape works inwardly as the strip always contracts inwardly with respect to the curve. This helps maintaining the excellent curved breast shape correcting and supporting function for a long time. The strip being a flat rubber strip makes the clothing comfortable to wear so that the wearer would not notice the presence of any foreign matter.

What is claimed is:

1. A female garment having a cup unit, comprising:

a breast retaining member including a curved, hardened region for correcting breast shape, the curved, hardened region being formed by molding a knitting fabric of thermoplastic synthetic resin fibers and arranged along a lower peripheral edge and a side peripheral edge of the cup unit, wherein the curved, hardened region having a curved strip with semicircular cross-section projecting outwardly, the curved strip extending in parallel with the lower peripheral edge and the side peripheral edge of the cup unit.

2. A female garment having a cup unit, comprising:

a breast retaining member including a curved, hardened region for correcting breast shape, the curved, hardened region being formed by molding a knitted fabric of thermoplastic synthetic resin fibers and arranged along a lower peripheral edge and a side peripheral edge of the cup unit, wherein the curved, hardened region having a curved strip with semicircular cross-section projecting outwardly, the curved strip extending in parallel with the lower peripheral edge and the side peripheral edge of the cup unit, and an elastic resin bar is attached on a recessed groove on a rear side of the curved strip.

3. A female garment having a cup unit, comprising:

a breast retaining member including a curved, hardened region for correcting breast shape the curved, hardened region being formed by molding a knitted fabric of thermoplastic synthetic resin fibers and arranged along a lower peripheral edge and a side peripheral edge of the cup unit, wherein a flat woven rubber string is sewn, while stretched, to a hem of an inner surface of the curved, hardened region along the lower peripheral edge and the side peripheral edge of the cup unit such that the curved, hardened region is provided with tension to inwardly contract by contraction of the flat woven rubber string.

4. The female garment having a cup unit as set forth in claim 1, wherein the curved strip is provided at an upper portion of the curved, hardened region.

5. The female garment having a cup unit as set forth in claim 1, wherein the curved strip is provided at a lower portion of the curved, hardened region.

6. The female garment having a cup unit as set forth in claim 1, in which a flat woven rubber string is sewn while stretched to a hem of an inner surface of the curved, hardened region, wherein the flat woven rubber string, while unstretched, is 15–20% shorter than the length of the hem of the inner surface of the hardened region.

7. The female garment having a cup unit as set forth in claim 1, wherein the female garment having a cup unit is a brassiere.

8. A female garment having a cup unit as set forth in claim 2, wherein the curved strip with semicircular cross-section projecting outward is provided at an upper portion of the curved, hardened region.

9. A female garment having a cup unit as set forth in claim 2, wherein the curved strip with semicircular cross-section projecting outward is provided at a lower portion of the curved, hardened region.

10. A female garment having a cup unit as set forth in claim 2, in which a flat woven rubber string is sewn, while stretched, to a hem of an inner surface of the curved, hardened region, wherein the flat woven rubber string, while unstretched, is 15–20% shorter than the length of the hem of the inner surface of the curved hardened region.

11. A female garment having a cup unit as set forth in claim 2, wherein the female garment having a cup unit is a brassiere.

12. A female garment having a cup unit as set forth in claim 3, wherein the female garment having a cup unit is a brassiere.

* * * * *